US010569954B2

(12) United States Patent
Heymann

(10) Patent No.: US 10,569,954 B2
(45) Date of Patent: Feb. 25, 2020

(54) GARBAGE CAN WITH INJECTION-MOLDED PLASTIC BODY

(71) Applicant: FRITZ SCHAEFER GmbH, Neunkirchen (DE)

(72) Inventor: Marco Heymann, Hoehn (DE)

(73) Assignee: FRITZ SCHAEFER GMBH, Neunkirchen (DE)

( * ) Notice: Subject to any disclaimer, the term of this patent is extended or adjusted under 35 U.S.C. 154(b) by 0 days.

(21) Appl. No.: 15/126,631

(22) PCT Filed: Apr. 14, 2015

(86) PCT No.: PCT/EP2015/058002
§ 371 (c)(1),
(2) Date: Sep. 16, 2016

(87) PCT Pub. No.: WO2015/158676
PCT Pub. Date: Oct. 22, 2015

(65) Prior Publication Data

US 2017/0081118 A1 Mar. 23, 2017

(30) Foreign Application Priority Data

Apr. 16, 2014 (DE) ..... 10 2014 207 356

(51) Int. Cl.
*B65D 21/04* (2006.01)
*B65F 1/14* (2006.01)
(Continued)

(52) U.S. Cl.
CPC ..... *B65F 1/14* (2013.01); *B65F 1/02* (2013.01); *B65F 1/1646* (2013.01); *B65F 2250/114* (2013.01)

(58) Field of Classification Search
CPC .. B65F 1/02; B65F 1/14; B65F 1/1646; B65F 2210/181; B65F 1/141; B65D 81/261;
(Continued)

(56) References Cited

U.S. PATENT DOCUMENTS 3,438,544 A * 4/1969 Cloyd ..... B65D 19/04 206/507
2014/0008360 A1* 1/2014 Philip ..... D06F 95/002 220/9.4

FOREIGN PATENT DOCUMENTS

DE 202011052245 U 2/2012
DE 202013000851 U 5/2013

* cited by examiner

*Primary Examiner* — Andrew T Kirsch
*Assistant Examiner* — Elizabeth J Volz
(74) *Attorney, Agent, or Firm* — Andrew Wilford

(57) ABSTRACT

The invention relates to a trash can (1) having an injection-molded plastic body (2) formed by side walls (3, 4, 5, 6) and a bottom wall (8) positioned relative to each other such that the side walls and the bottom wall together define a cavity (15) having an opening (17) opposite the bottom wall (8), each side wall (3, 4, 5, 6) integrally merging into the adjacent side walls at common corners (11, 12, 13, 14), and a stand strip (26) extending at least partially along edges (27, 28, 29) of a lower face (25) of the bottom wall (8) directed away from the cavity (15) is provided on the lower face (25) and has curved short stand-strip segments (30, 31) at some of the common corners (11, 12, 13, 14) joined to long stand-strip segments (32, 33, 34), characterized in that the curved short stand-strip segments (30, 31) are at least partially decoupled from the long stand-strip segments (32, 33, 34) by cutouts (35, 36, 37, 38).

12 Claims, 2 Drawing Sheets

Figure 1:
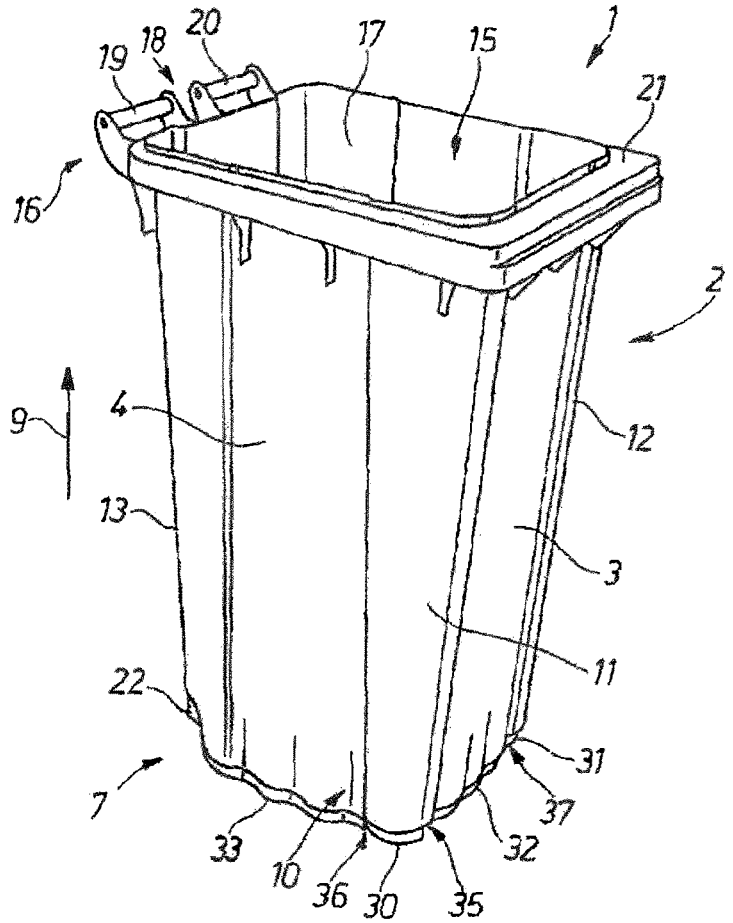

(51) Int. Cl.
*B65F 1/02* (2006.01)
*B65F 1/16* (2006.01)

(58) Field of Classification Search
CPC ..... B65D 21/0215; B65D 2519/008; B65D 2519/003; B65D 1/44; Y10S 220/908
USPC ..... 220/608, 908, 495.1, 495.06, 495.11, 220/908.1, 605, 606, 628, 913, 635, 636, 220/669, 676; 206/511; 248/97
See application file for complete search history.

GARBAGE CAN WITH INJECTION-MOLDED PLASTIC BODY

CROSS REFERENCE TO RELATED APPLICATIONS

This application is the US-national stage of PCT application PCT/EP2015/058002 filed 14 Apr. 2015 and claiming the priority of German patent application 102014207356.1 itself filed 16 Apr. 2014.

The invention relates to a trash can having an injection-molded plastic body formed by side walls and a bottom wall positioned relative to each other such that the side walls and the bottom wall together define a cavity open away from the bottom wall, each side wall integrally merging into each other at common corners, and a stand strip extending at least partially along the edges of a lower face of the bottom wall directed away from the cavity, is provided on the lower face, and has at some of the common corners curved short stand-strip segments that are adjoined by long stand-strip segments.

The trash cans in question are already known in the art. Such trash cans may be provided by municipalities for home use, with different filling capacities of 60 l, 120 l, 240 l, 360 l, or similar, for example, in order to store household trash, biological waste or similar, and for a disposal in return for payment.

DE 20 2013 000 851, for example, discloses a trash can made by injection molding in one piece of plastic. This trash can is essentially comprised of a bottom as well as four walls projecting upward therefrom. On its lower face, the bottom wall is provided with a stand strip on three sides of the trash can, on which the trash can sit when it is correctly placed on the floor. This stand strip is provided underneath corners between the front wall and side walls of the trash can with curved stand-strip segments joined by long straight segments of the stand strip.

The object of the invention is to improve on a trash can of this type and to facilitate its daily use.

This object of the invention is attained by a trash can with an injection-molded plastic body formed by side walls and a bottom wall positioned relative to each other such that the side walls and the bottom wall together define a cavity open away from the bottom wall, each side wall merging integrally the adjacent side walls at common corners, a stand strip extending at least partially along the edges of a lower face of the bottom wall directed away from the cavity being provided on the lower face and having at some of the corners curved short stand-strip segments that are joined to respective long stand-strip segments, the curved short stand-strip segments being at least partially decoupled from the long stand-strip segments by cutouts.

Due to the fact that the stand strip is, in some regions, interrupted by the cutouts, blows transmitted to the stand strip of the trash can, for example, during placement of the trash can on a floor, may be much better mitigated by the stand strip, so that the risk that the side walls and/or the bottom wall of the trash can are damaged and are irreversibly deformed can be significantly reduced.

The cutouts may be provided in different positions along the stand strip. However, impact forces may be very effectively absorbed by the stand strip when the cutouts are provided at the merges between the short stand-strip segments and the long stand-strip segments.

It is clear that these cutouts may be provided in many different ways. In an example, if the cutouts are complementary, only the thickness of the stand strip is reduced, so that a remaining thin web of the stand strip may be more easily elastically deformed than a massive stand strip. In this way a certain separation of regions of stand strip may be achieved.

The thickness of the stand strip according to the invention extends transversely with respect to the longitudinal extension of stand strip.

The curved short stand-strip segments may also be partially provided with straight regions in the direction of their respective longitudinal extension.

The cutouts are preferably provided through the entire thickness of the stand strip so that a very good decoupling between the curved short stand-strip segments and the long stand-strip segments may be achieved.

If the cutouts have a depth greater than one third or more than half, preferably at least two thirds, of the height of the stand strip, a very good decoupling between the curved short stand-strip segments and the long stand-strip segments may be achieved.

It is also advantageous if the cutouts have a length greater than their depth. In this way, a sufficiently large gap is formed between the curved short stand-strip segments and the long stand-strip segments, so that the curved short stand-strip segments and the long stand-strip segments may be deformed toward each other without touching.

Better tension response, in particular between the bottom wall and the stand strip in the case of impact of the stand strip on a floor, may be achieved if the cutouts are defined by a concave edge of the stand strip.

It is also advantageous if the cutouts are provided in a curved region of the stand strip. It has been shown that the trash can normally impacts the ground underneath the front corner. In these corners, the stand strip is curved. In this sense, the cutouts may be advantageously provide at the curved short stand-strip segments.

In particular, the front long stand-strip segment provided underneath the front side wall may be spatially separated from the two curved short stand-strip segments, if two of the cutouts are provided underneath the front side wall of the trash can. Moreover, the front long stand-strip segment, in the case of impact on a floor, may be elastically deformed independently from the curved short stand-strip segments, so that the risk is reduced that the front corners of the trash can undergo a critical deformation at their lower ends.

If a curved short stand-strip segment is separated by two cutouts, it can, on the one hand, be decoupled from a long stand-strip segment positioned underneath the front side wall and, on the other hand, from a long stand-strip segment positioned underneath a lateral side wall.

In particular, the long stand-strip segments of the stand strip may better absorb impact loads if the long stand-strip segments are corrugated in the direction of their longitudinal extension. To this end, the long stand-strip segments are repeatedly curved in opposite directions along their longitudinal extension.

In this sense, it is advantageous if the long stand-strip segments are provided in their longitudinal direction with alternating valleys and ridges. In this way, a greater quantity of material, with respect to a longitudinal segment of the respective long stand-strip segment may be accumulated on the stand strip, so that the stand strip is stiffer in its entirety.

According to a preferred alternative embodiment the stand strip is provided with a labyrinthine longitudinal cross section of the long stand strip in its longitudinal direction. In this way, the stand strip may be given higher strength, in particular with respect to impact loads.

A further improved embodiment of the trash can with respect to impact-like loads may be achieved if the stand strip is provided, in its longitudinal direction, with differently shaped labyrinthine longitudinal cross-sections of the long stand-strip segments.

In particular, it is advantageous if front long stand-strip segments positioned underneath the front side wall of the trash can are provided with a denser labyrinthine longitudinal cross-section of the stand strip than the long stand-strip segments positioned underneath the side walls. In this way, on one hand, the front long stand-strip segment may be particularly stable. On the other hand, it is possible to reduce the use of material for the lateral long stand-strip segments, since these are subject to less powerful impacts and/or these impact loads are less frequently experienced by them.

The characteristics of a corrugated stand strip or of a labyrinthine longitudinal cross-section of the stand strip alone may already achieve an advantageous improvement of the trash can in question, so that the corresponding combinations of characteristics may already be advantageous without the remaining characteristics of the invention.

As a result, the decoupling according to the invention of the curved short stand-strip segments from the adjacent long stand-strip segments has the advantage that in case of impact of the trash can with its stand strip on the bottom wall on a floor, the front side wall may be better decoupled from tensions arising in the lateral side walls. The risk of overloading the plastic body of the trash can is greatly reduced. It happens often that trash cans are irreversibly damaged after such an impact and have to be replaced. This is in particular the case of filled trash cans that may reach a weight of 100 kg.

Further characteristics, effects and advantages of this invention are explained with reference to the attached drawing and the following description, in which an embodiment of the trash can according to the invention is shown and described.

Figure 2:
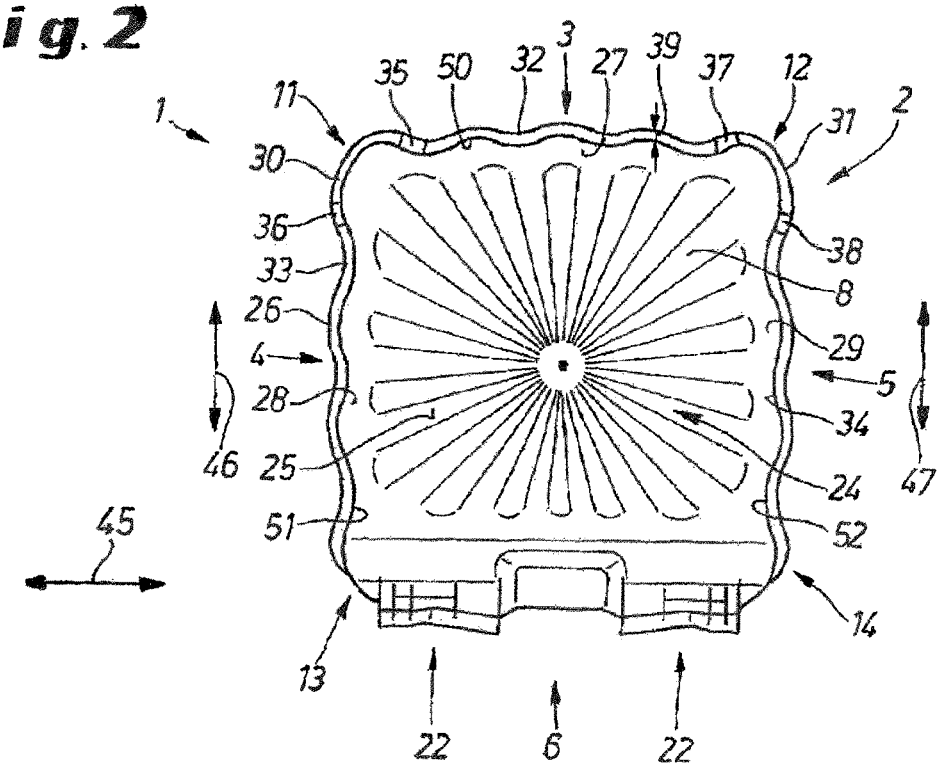
Figure 3:
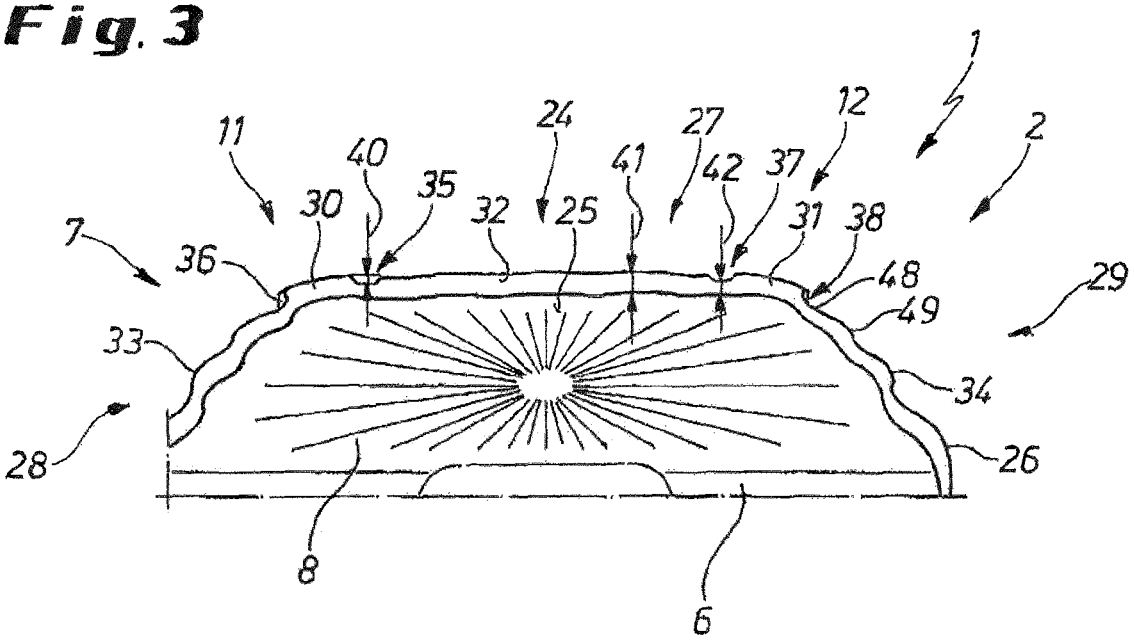
Figure 4:
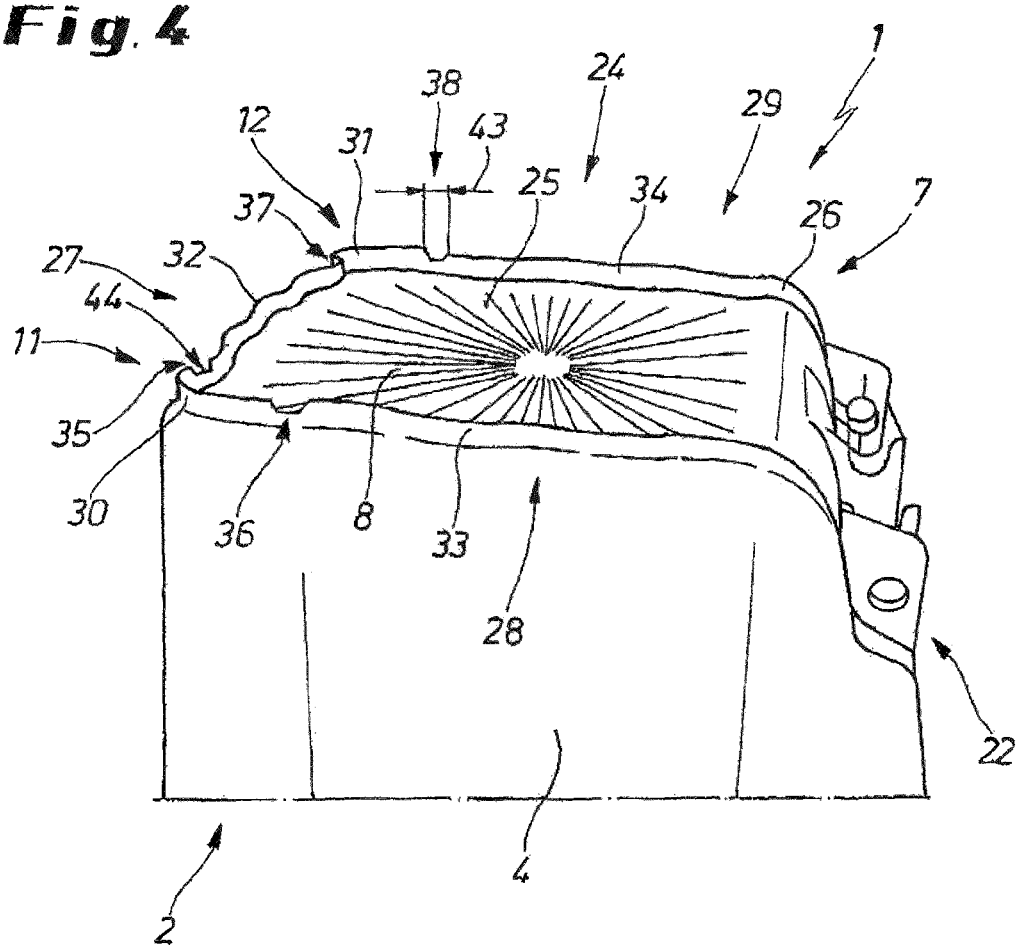

In the drawing, in particular:

FIG. 1 is a schematic and perspective view of a trash can with a corrugated stand strip provided under a bottom wall with long stand-strip segments that are at least partially decoupled from curved short stand-strip segments by cutouts, FIG. 2 is a schematic view of a lower face of the bottom wall of the trash can of FIG. 1, FIG. 3 is a schematic and perspective view of the lower face of the bottom wall, viewed from a back side wall of the trash can, of FIGS. 1 and 2; and FIG. 4 is a further schematic and perspective view, viewed from a lateral side wall of the trash can of FIGS. 1 to 3.

A trash can 1 shown in FIG. 1 has an injection-molded plastic body 2. This injection-molded plastic body 2 forms side walls 3, 4, 5 and 6 of, i.e. a front side wall 3, a first lateral side wall 4, a second lateral side wall 5 and a back side wall 6. The trash can 1 is also provided on its underside 7 with a bottom wall 8 also formed by the injection-molded plastic body 2. The side walls 3, 4, 5 and 6 extend from the bottom wall 8 upward in a direction 9, and the side walls 3, 4, 5, 6 are integrally connected with this bottom wall 8 at their respective lower ends 10 (with exemplary numbering). Both lateral side walls 4 and 5 are connected at two front corners 11 and 12 of, to the opposite front side wall 3 and in two back corners 13 and 14 of are integrally connected to the opposite back side wall 6.

The side walls 3, 4, 5 and 6 as well as the bottom wall 8 are positioned with respect to each other such that they define together a cavity 15 for holding trash. This cavity 15 may be accessed from the upper side 16 of the trash can 1 through an opening 17 and may be closed by an unillustrated lid. The lid may be rotatably attached by a support 18 embedded in two handles 19 and 20 of the trash can 1, on the same trash can 1. The opening 17 is surrounded by an overhang edge 21 that also represents an upper end of the trash can 1, on which the lid is placed, when the trash can 1 is closed. At the same time, the overhang edge 21 allows the insertion of lifting devices for lifting the trash can 1, for example, when emptying the trash can 1 into a dumpster.

On the back side wall 6 and above the bottom wall 8 an axial support 22 is also provided (see also FIGS. 2 and 4), by means of which a wheel axle (not shown) may be supported, so that the trash can 1 may also roll.

According to FIGS. 2, 3 and 4, on the underside 7 of the trash can 1, more precisely on a bottom-wall underside 24, of a correspondingly outer lower face 25 of t bottom wall 8, a stand strip 26 is provided, on which the trash can 1 stands on a floor.

This stand strip 26 extends along edges 27, 28 and 29 of the lower face 25. The stand strip 26 is here provided on the front corners 11 and 12 with curved short stand-strip segments 30 and 31. Underneath the front side wall 3, between the two front corners 11 and 12 a corrugated front long stand-strip segment 32 is provided and underneath the lateral side walls 4 and 5 respective corrugated lateral long stand-strip segments 33 and 34 are provided.

In particular, according to the further illustrations of FIGS. 3 and 4, it may be seen that both curved short stand-strip segments 30 and 31 are decoupled from the adjoining long stand-strip segments 32, 33 and 34 by respective cutouts 35 and 36 (first short stand-strip segments 30) and 37 and 38 (second short stand-strip segments 31), so that the stand strip 26 has much better damping properties.

The cutouts 35 to 38 are formed through the entire thickness 39 (see FIG. 2) of the stand strip 26 with a depth 40 (see FIG. 3) in this example corresponding approximately to two thirds of a height 41 of the stand strip 36 (see FIG. 3). In this sense, the stand strip 26 has, at the deepest point of the respective cutouts 35 to 38 still a minimum height 42 (see FIG. 3), so that the stability of the surrounding stand strip 26 is improved. A length 43 (see FIG. 4) of cutouts 35 to 38 is greater than their depth 40 (see FIG. 3). Cutouts 35 to 38 are also defined by a convex edge 44 (see FIG. 4) of the stand strip 26 so that an improved distribution of tensions in the stand strip 26 is achieved at the cutouts 35 to 38.

It can also be readily seen that the cutouts 35 to 38 are placed in a curved region (without explicit numbering) of the curved short stand-strip segments 30 and 31.

The stand strip 26 is also provided with an improved stability, since the long stand-strip segments 32, 33, 34 are corrugated in the direction of their respective longitudinal extensions 45, 46 or 47. The long stand-strip segments 32, 33, 34 are also provided in the direction of their respective longitudinal extensions 45, 46, 47 with alternating valleys 48 (only exemplary numbering, see FIG. 3) and ridges 49 (also only exemplary numbering).

Overall, the stand strip 26 is characterized by a labyrinthine longitudinal stand-strip cross-section, and the it is provided in certain regions with a different labyrinthine form. The front long stand-strip segment 32 underneath the front side wall 3, is provided with a tighter labyrinthine longitudinal stand-strip cross-section 50 (see FIG. 2) than the further labyrinthine longitudinal stand-strip cross-sections 51 or 52 (see FIG. 2) of the long stand-strip segments 33 or 34 which are underneath the lateral side walls 4 or 5.

It is understood that this illustrated embodiment is only a first embodiment of the inventive trash can. In this sense, the invention is not limited to this illustrated embodiment.

All characteristics that are disclosed in the application files are claimed as essential to the invention, provided that they, individually or in combination, are new with respect to the prior art.

| | |
|---|---|
| 1 | trash can |
| 2 | plastic body |
| 3 | front side wall |
| 4 | first lateral side wall |
| 5 | second lateral side wall |
| 6 | back side wall |
| 7 | underside |
| 8 | bottom wall |
| 9 | direction |
| 10 | lower ends |
| 11 | first front corner |
| 12 | second front corner |
| 13 | first back corner |
| 14 | second back corner |
| 15 | cavity |
| 16 | upper side |
| 17 | opening |
| 18 | support |
| 19 | first handle |
| 20 | second handle |
| 21 | overhang edge |
| 22 | axial support |
| 24 | bottom wall underside |
| 25 | lower face |
| 26 | stand strip |
| 27 | front edge |
| 28 | first lateral edge |
| 29 | second lateral edge |
| 30 | first curved short stand-strip segment |
| 31 | second curved short stand-strip segment |
| 32 | front long stand-strip segment |
| 33 | first lateral long stand-strip segment |
| 34 | second lateral long stand-strip segment |
| 35 | first material recess |
| 36 | second material recess |
| 37 | third material recess |
| 38 | fourth material recess |
| 39 | thickness |
| 40 | depth |
| 41 | height of stand strip |
| 42 | minimum height |
| 43 | length |
| 44 | convex edge |
| 45 | first longitudinal extension |
| 46 | second longitudinal extension |
| 47 | third longitudinal extension |
| 48 | valleys |
| 49 | valleys |
| 50 | tight labyrinthine longitudinal stand-strip cross-section |
| 51 | wider labyrinthine longitudinal stand-strip cross-section |
| 52 | wider labyrinthine longitudinal stand-strip cross-section |

The invention claimed is:

1. A trash can having an injection-molded one-piece plastic body formed by:

upright side walls, a horizontal bottom wall positioned relative to the side walls such that the side walls and the bottom wall together define an upwardly open cavity defining an opening opposite the bottom wall, each side wall integrally merging into the adjacent side walls at common corners, and a stand strip extending as downward extensions of the side walls from the bottom wall at least partially along an outer edge of a lower face of the bottom wall, the stand strip downward from the bottom wall and being formed by curved short stand-strip segments at the common corners and long stand-strip segments extending along lower edges of at least three of the side walls between the curved short stand-strip segments, the can being supported when standing on a support surface wholly by engagement of a lower edge of the stand strip, with the stand strip thus holding the entire bottom wall inward of the stand strip up out of contact with the support surface, the stand strip supporting the bottom wall wholly above and out of contact with a support surface engaged by lower edges of the stand strip when the can is standing upright on the surface, the curved short stand-strip segments each being decoupled from the long stand-strip segments by two respective downwardly open cutouts at ends of the curved short stand-strip segments, each of the long stand-strip segments extending between a respective pair of the cutouts and being substantially longer than any of the short stand-strip segments.

2. The trash can according to claim 1, wherein the cutouts each extend through the entire thickness of the stand strip.

3. The trash can according to claim 1, wherein the cutouts have a depth greater than a third or half of a height of the stand strip.

4. The trash can according to claim 1, wherein the cutouts each have a length greater than their depth.

5. The trash can according to claim 1, wherein the cutouts are each defined by a concave edge of the stand strip.

6. The trash can according to claim 1, wherein the cutouts are each provided in a curved region of the stand strip.

7. The trash can according to claim 1, wherein two of the cutouts are provided underneath the front side wall of the trash can.

8. The trash can according to claim 1, wherein the long stand-strip segments have a corrugated configuration in their longitudinal direction.

9. The trash can according to claim 1, wherein the long stand-strip segments have alternating valleys and ridges in their respective longitudinal directions.

10. The trash can according to claim 1, wherein the stand strip has a labyrinthine longitudinal cross-section in its longitudinal direction.

11. The trash can according to claim 1, wherein the stand strip is provided with differently shaped labyrinthine longitudinal cross-sections of the long stand-strip segments in its longitudinal direction.

12. The trash can according to claim 1, wherein the front long stand-strip segment underneath the front side wall of the trash can is provided with a tighter labyrinthine longitudinal cross-section than the long stand-strip segments positioned underneath the lateral side walls.

* * * * *